US011183768B1

(12) United States Patent
Taylor et al.

(10) Patent No.: US 11,183,768 B1
(45) Date of Patent: Nov. 23, 2021

(54) DUAL BOOM DEPLOYABLE PARABOLIC TROUGH REFLECTOR

(71) Applicant: Eagle Technology, LLC, Melbourne, FL (US)

(72) Inventors: Robert M. Taylor, Rockledge, FL (US); David Lopez, Malabar, FL (US); Timothy L. Fetterman, Palm Bay, FL (US); Stephen Jenkins, Melbourne, FL (US); Christopher Rose, Palm Bay, FL (US); Philip J. Henderson, Palm Bay, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 0 days.

(21) Appl. No.: 16/941,909

(22) Filed: Jul. 29, 2020

(51) Int. Cl.
*H01Q 15/16* (2006.01)
*H01Q 1/28* (2006.01)
*H01Q 1/10* (2006.01)

(52) U.S. Cl.
CPC ..... *H01Q 15/161* (2013.01); *H01Q 1/10* (2013.01); *H01Q 1/288* (2013.01)

(58) Field of Classification Search
CPC ..... H01Q 1/28; H01Q 1/288; H01Q 15/161; H01Q 1/10; H01Q 1/14; H01Q 1/1242; H01Q 15/16; H01Q 15/168; H02S 40/22; H02S 30/20; F24S 23/74; F24S 23/745; F24S 23/71; F24S 23/715
USPC ..... 343/833
See application file for complete search history.

(56) References Cited

U.S. PATENT DOCUMENTS

| | | | |
|---|---|---|---|
| 2,784,987 | A | 3/1957 | Corcoran |
| 2,888,111 | A | 5/1959 | Evans |
| 3,361,456 | A | 1/1968 | Durand |
| 3,474,833 | A | 10/1969 | Garrette et al. |
| 3,688,455 | A | 9/1972 | Zebuhr |
| 4,047,821 | A | 9/1977 | Hoke et al. |
| 4,062,156 | A | 12/1977 | Roth et al. |
| 4,079,987 | A | 3/1978 | Bumgardener |
| 4,254,423 | A | 3/1981 | Reinhard |
| 4,385,849 | A | 5/1983 | Crain |

(Continued)

OTHER PUBLICATIONS

F. Jensen and S. Pelligrino, "Arm Development Review of Existing Technologies," www-civ.eng.cam.ac.uk/dsl/publications/TR198.pdf, Jun. 25, 2001.

(Continued)

*Primary Examiner* — Dimary S Lopez Cruz
*Assistant Examiner* — Yonchan J Kim
(74) *Attorney, Agent, or Firm* — Fox Rothschild LLP; Robert J. Sacco; Carol E. Thorstad-Forsyth

(57) ABSTRACT

A method for deploying a trough structure. The methods comprise: causing a first telescoping segment to move in a first direction away from a proximal end of a telescoping boom; and transiting a flexible element from an untensioned state to a tensioned state as the first telescoping segment is moved in the first direction. The flexible element is coupled to a distal end of the first telescoping segment by a first bulkhead and is coupled to a distal end of a second telescoping segment by a second bulkhead. The first telescoping segment is coupled to the second telescoping segment of the boom when the first telescoping segment reaches an extended position. The flexible element has a parabolic trough shape when in the tensioned state.

25 Claims, 11 Drawing Sheets

(56) References Cited

U.S. PATENT DOCUMENTS

| | | | | |
|---|---|---|---|---|
| 4,587,526 | A | 5/1986 | Ahl, Jr. | |
| 4,613,870 | A * | 9/1986 | Stonier | H01Q 15/161 343/915 |
| 4,657,112 | A | 4/1987 | Ream et al. | |
| 4,663,900 | A | 5/1987 | Rehm et al. | |
| 4,793,197 | A | 12/1988 | Petrovsky | |
| 4,845,511 | A * | 7/1989 | Grayson | H01Q 15/162 343/915 |
| 4,871,138 | A | 10/1989 | Sauter | |
| 5,163,650 | A | 11/1992 | Adams et al. | |
| 5,279,084 | A | 1/1994 | Atsukawa | |
| 5,315,795 | A * | 5/1994 | Chae | B66F 11/00 343/874 |
| 5,990,851 | A * | 11/1999 | Henderson | H01Q 1/081 343/840 |
| 6,095,714 | A | 8/2000 | Spencer | |
| 6,353,421 | B1 | 3/2002 | Lalezari et al. | |
| 7,299,589 | B2 | 11/2007 | Campbell et al. | |
| 8,035,573 | B2 | 10/2011 | Thompson et al. | |
| 9,828,772 | B2 | 11/2017 | Murphey et al. | |
| 10,059,471 | B2 * | 8/2018 | Steele | B65H 75/28 |
| 10,131,452 | B1 | 11/2018 | Rohweller et al. | |
| 2003/0160733 | A1 * | 8/2003 | Lee | H01Q 19/175 343/912 |
| 2007/0145195 | A1 | 6/2007 | Thomson et al. | |
| 2013/0207880 | A1 * | 8/2013 | Taylor | H01Q 15/161 343/915 |
| 2019/0144139 | A1 | 5/2019 | Marks | |
| 2020/0358200 | A1 * | 11/2020 | Freebury | H01Q 15/20 |

OTHER PUBLICATIONS

Fenci, GE and Currie, NGR, "Deployable structures classification : a review", http://usir.salford.ac.uk/id/eprint/43146/, published 2017.

Murphey, Thomas & Zatman, Michael. (2011). Overview of the Innovative Space-Based Radar Antenna Technology Program. Journal of Spacecraft and Rockets—J Spacecraft Rocket. 48. 135-145. 10.2514/1.50252.

* cited by examiner

DUAL BOOM DEPLOYABLE PARABOLIC TROUGH REFLECTOR

BACKGROUND

Statement of the Technical Field

This disclosure concerns compact antenna system structures. More particularly, this disclosure concerns dual boom deployable parabolic trough reflectors (e.g., for satellites).

Description of the Related Art

Antennas and instruments often need to be deployed away from a satellite to function. Different system functions require different antenna styles to meet requirements. In particular, Moving Target Indication ("MTI") radars need an aperture that is long in one direction, narrow in the other direction, and provides some scan angle to increase coverage from orbit. In the past, development work and a partial model of a 300 meter long by 10 meter wide trough reflector was demonstrated on the ground to represent an MTI radar for Medium Earth Orbit ("MEO") orbit.

SUMMARY

This document concerns systems and methods for deploying a trough structure. The methods comprise: causing a first telescoping segment to move in a first direction away from a proximal end of a telescoping boom; transiting a flexible element from an untensioned state to a tensioned state as the first telescoping segment is moved in the first direction, where the flexible element is coupled to a distal end of the first telescoping segment by a first bulkhead and is coupled to a distal end of a second telescoping segment by a second bulkhead; and coupling the first telescoping segment to the second telescoping segment of the boom when the first telescoping segment reaches an extended position. The flexible element has a parabolic trough shape when in the tensioned state.

In some scenarios, a third telescoping segment (without any bulkheads coupled thereto) is used at a distal end of the telescoping boom for reacting to forces applied by the flexible element to the first and second bulkheads. A distal end of the third telescoping segment is coupled to the first bulkhead via at least one cord.

In those or other scenarios, a tension cord truss or a plurality of foldable elements is used to facilitate formation of the parabolic trough shape of the flexible element. The tension cord truss may be configured to eliminate a bending of the first telescoping boom resulting from at least one of a load applied by the flexible element and an environmental load, or react along with the first telescoping boom to at least one of a load applied by the flexible element and an environmental load. A tension cord network (coupled to the first and second bulkheads) may also or additionally be used to maintain the parabolic trough shape of the flexible element. The tension cord network may comprises a first taught cord that extends diagonally between the first and second bulkheads, a second taught cord that extends between adjacent ends of the first and second bulkheads, and/or a catenary cord that extends between the adjacent ends of the first and second bulkheads.

In those or other scenarios, the flexible element comprises a reflector for an antenna system. At least one feed panel is caused to transition from a folded position to an unfolded position as the first telescoping segment is moved in the first direction. The feed panel is coupled between the first and second bulkheads. The feed panel is used to illuminate the reflector with Radio Frequency ("RF") energy.

In those or other scenarios, the deployable trough structure also comprises a second telescoping boom that is offset from the first telescoping boom and configured to be deployed in a direction opposite from the direction in which the first telescoping boom deploys. At least a portion of second telescoping boom may overlap at least a portion of the first telescoping boom when the first and second telescoping booms are in a stowed position and an extended position.

BRIEF DESCRIPTION OF THE DRAWINGS

This disclosure is facilitated by reference to the following drawing figures, in which like numerals represent like items throughout the figures.

DETAILED DESCRIPTION

Figure 1:
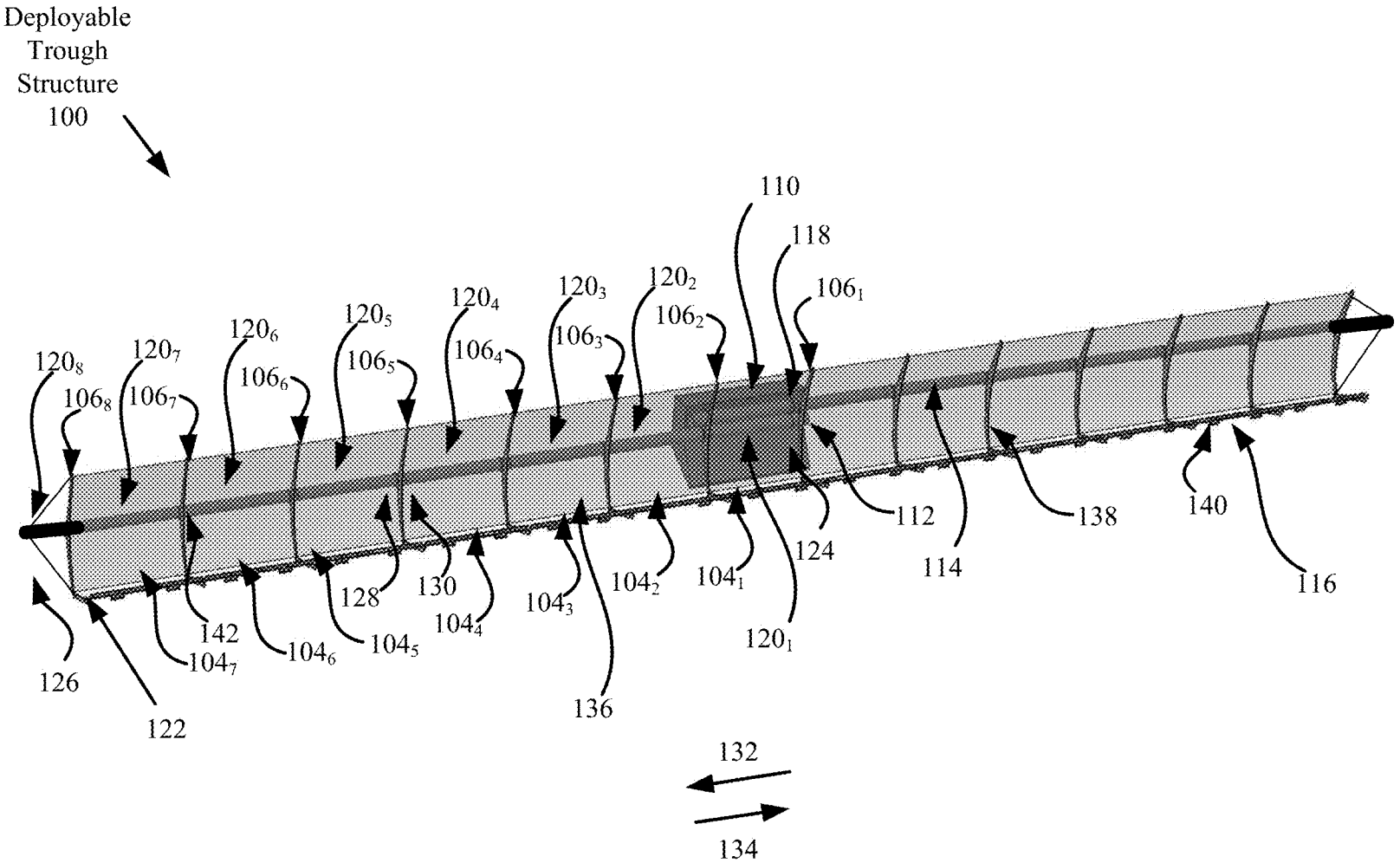
FIG. 1 provides a front perspective view of an illustrative architecture for a deployable trough structure.

It will be readily understood that the solution described herein and illustrated in the appended figures could involve a wide variety of different configurations. Thus, the following more detailed description, as represented in the figures, is not intended to limit the scope of the present disclosure but is merely representative of certain implementations in various different scenarios. While the various aspects are presented in the drawings, the drawings are not necessarily drawn to scale unless specifically indicated.

Reference throughout this specification to features, advantages, or similar language does not imply that all of the features and advantages that may be realized should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Small satellites create the possibility of more systems. For example, MTI could be done from a Low Earth Orbit ("LEO") using a constellation of small satellites. A deployable system for a small satellite needs to be simpler than the conventional trough reflector mentioned in the background section of this paper so as to reduce the cost of the constellation. Therefore, there is a need for a new small satellite trough reflector that is integrated with a deployable feed panel for scanning the beam.

The large space based antenna system described above used a series of deployable bays where each bay contains a parabolic trough of Radio-Frequency ("RF") reflective mesh illuminated by a phased array feed. The mesh surface of each bay is supported by a deployable set of radial arms around a hub. The phased array feed panels in each bay are mounted to a rigid truss structure that is deployed using four jack screws. This design has certain drawbacks. For example, this design has a relatively complex deployment process and has a relatively large stowed size at least partially due to the size of the feed panels. Trough reflectors have also been used as ground based solar concentrators with mirror segments. These trough reflectors are not practical for space based applications because of their overall non-deployable designs. Accordingly, there is no practical space based trough reflector in existence today. Therefore, the present document is directed to such a practical trough reflector that can be used in space. The present trough reflector will now be described in relation to the drawings.

Figure 2:
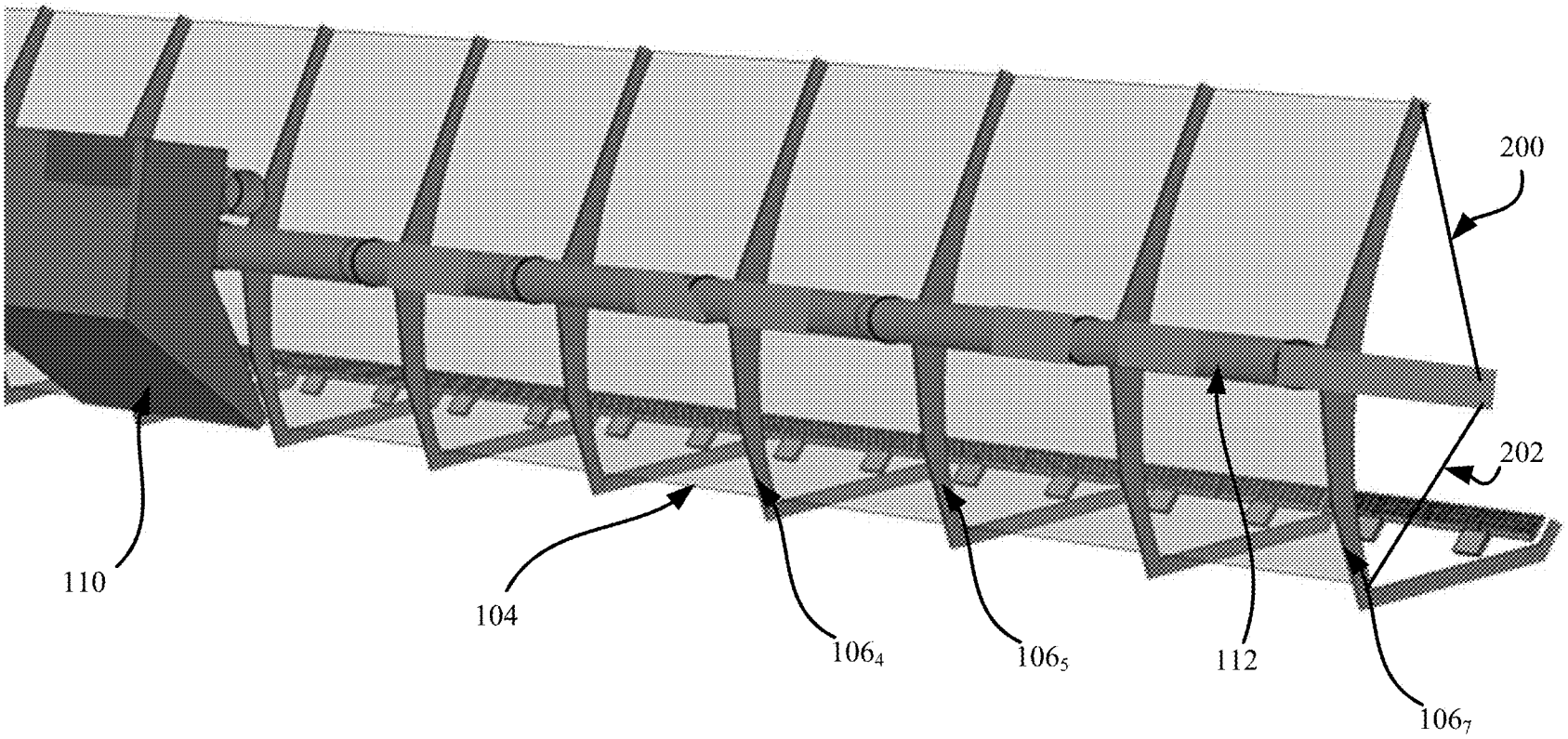
FIG. 2 provides a partial back perspective view of the deployable trough structure shown in FIG. 1.

Referring now to FIGS. 1-2, there are provided front and partial back perspective views of an illustrative architecture for a deployable trough structure 100. In some scenarios, the deployable trough structure comprises a reflector that can be used with a satellite at LEO. In other scenarios, the deployable trough structure is used as a solar collector. The present solution is not limited to these applications.

As shown in FIGS. 1-2, the deployable trough structure 100 comprises two telescoping booms 112, 114 that are coupled to a support structure 110. The telescoping booms 112, 114 are oriented in opposite directions in FIGS. 1-2. The present solution is not limited in this regard. The telescoping booms may alternatively have a stacked boom design or be coaxial/in-line with one another. The deployable trough structure 100 is in a deployed position in FIGS. 1-2. An illustration showing the deployable trough structure 100 in a stowed or collapsed position is provided in FIG. 3. In space applications, the support structure 110 may comprise a satellite or other vehicle.

The coupling between the telescoping booms 112, 114 and the support structure 110 can be achieved using mechanical couplers 118 (e.g., brackets, screws, bolts, nuts and/or other mechanical coupling means), welds and/or adhesives. Each telescoping boom 112, 114 can be coupled to the support structure 110 at one location (not shown) or multiple locations (e.g., two locations as shown in FIGS. 1-2). The couplers 118 ensure that a base segment $\mathbf{120}_1$ of the telescoping boom remains in the same position relative to the support structure 110 while the trough structure 100 is in a collapsed positon shown in FIG. 3 and also while the trough structure 100 is in a deployed positon shown in FIG. 1.

Each telescoping boom 112, 114 comprises a plurality of telescoping segments $\mathbf{120}_2$, $\mathbf{120}_3$, $\mathbf{120}_4$, $\mathbf{120}_6$, $\mathbf{120}_7$, $\mathbf{120}_8$ which can collapse into and extend out from the base segment $\mathbf{120}_1$. The telescoping booms are shown as having eight telescoping segments. The present solution is not limited in this regard. The telescoping booms can have any number of telescoping segments selected in accordance with a given application. For example, in some scenarios, each telescoping boom is absent of telescoping segment $\mathbf{120}_8$ which is provided as a boom extension for reacting to forces applied by the flexible element 104 to the booms and/or bulkheads. In this scenario, reaction to these forces of the flexible element 104 is provided by a relatively thick distal bulkhead. The present solution is not limited to the particulars of this example.

Telescoping segment $\mathbf{120}_8$ is the inner most telescoping segment, and telescoping segment $\mathbf{120}_1$ is the outermost telescoping segment. Telescoping segments $\mathbf{120}_2$-$\mathbf{120}_7$ each comprise a middle telescoping segment. The telescoping segments $\mathbf{120}_1$-$\mathbf{120}_8$ may comprise compression-only members of structure 100, i.e., the telescoping segments $\mathbf{120}_1$-$\mathbf{120}_8$ are designed such that they do not experience any bending or other deformation when fully extended.

The diameter of the inner most telescoping segment $\mathbf{120}_8$ is slightly smaller than the diameter of the adjacent middle telescoping segment $\mathbf{120}_7$ such that the inner most telescoping segment $\mathbf{120}_8$ can slide within telescoping segment $\mathbf{120}_7$ in two opposing directions shown by arrows 132, 134. The telescoping segments $\mathbf{120}_8$, $\mathbf{120}_7$ have flanges or other features that prevent the inner most telescoping segment $\mathbf{120}_8$ from sliding completely out of the middle telescoping segment $\mathbf{120}_7$ when being extended and/or collapsed. Similarly, middle telescoping segment $\mathbf{120}_7$ has a diameter slightly smaller than the diameter of an adjacent middle telescoping segment $\mathbf{120}_6$ such that the telescoping segment $\mathbf{120}_7$ can slide within telescoping segment $\mathbf{120}_6$ in the two opposing directions shown by arrows 132, 134. The telescoping segments $\mathbf{120}_7$, $\mathbf{120}_6$ have flanges or other features that prevent the telescoping segment $\mathbf{120}_7$ from sliding completely out of the telescoping segment $\mathbf{120}_6$ when being extended and/or collapsed. Likewise, middle telescoping segment $\mathbf{120}_6$ has a diameter slightly smaller than the diameter of adjacent middle telescoping segment $\mathbf{120}_5$ such that the telescoping segment $\mathbf{120}_6$ can slide within telescoping segment $\mathbf{120}_5$ in two opposing directions shown by arrows 132, 134. The telescoping segments $\mathbf{120}_6$, $\mathbf{120}_5$ have flanges or other features that prevent the telescoping segment $\mathbf{120}_6$ from sliding completely out of the telescoping segment $\mathbf{120}_5$ when being extended and/or collapsed.

Middle telescoping segment $\mathbf{120}_5$ has a diameter slightly smaller than the diameter of adjacent middle telescoping segment $\mathbf{120}_4$ such that the telescoping segment $\mathbf{120}_5$ can slide within telescoping segment $\mathbf{120}_4$ in two opposing directions shown by arrows 132, 134. The telescoping segments $\mathbf{120}_5$, $\mathbf{120}_4$ have flanges or other features that prevent the telescoping segment $\mathbf{120}_5$ from sliding completely out of the telescoping segment $\mathbf{120}_4$ when being extended and/or collapsed. Middle telescoping segment $\mathbf{120}_4$ has a diameter slightly smaller than the diameter of adjacent middle telescoping segment $\mathbf{120}_3$ such that the telescoping segment $\mathbf{120}_4$ can slide within telescoping segment $\mathbf{120}_3$ in two opposing directions shown by arrows 132, 134. The telescoping segments $\mathbf{120}_4$, $\mathbf{120}_3$ have flanges or other features that prevent the telescoping segment $\mathbf{120}_4$ from sliding completely out of the telescoping segment $\mathbf{120}_3$ when being extended and/or collapsed. Middle telescoping segment $\mathbf{120}_3$ has a diameter slightly smaller than the diameter of adjacent middle telescoping segment $\mathbf{120}_2$ such that the telescoping segment $\mathbf{120}_3$ can slide within telescoping segment $\mathbf{120}_2$ in two opposing directions shown by arrows 132, 134. The telescoping segments $\mathbf{120}_3$, $\mathbf{120}_2$ have flanges or other features that prevent the telescoping segment $120_3$ from sliding completely out of the telescoping segment $120_2$ when being extended and/or collapsed. Middle telescoping segment $120_2$ has a diameter slightly smaller than the diameter of the outermost telescoping segment $120_1$ such that the telescoping segment $120_2$ can slide within telescoping segment $120_1$ in two opposing directions shown by arrows 132, 134. The telescoping segments $120_2$, $120_1$ have flanges or other features that prevent the telescoping segment $120_2$ from sliding completely out of the telescoping segment $120_1$ when being extended and/or collapsed.

The telescoping booms 112, 114 extend in opposing directions. More specifically, telescoping boom 112 is arranged to point and extend in direction shown by arrow 132, while telescoping boom 114 is arranged to point and extend in the opposite direction shown by arrow 134. The telescoping booms 112, 114 are formed of any suitable material such as a metal material, a graphite material and/or a dielectric material. In the dielectric material scenarios, the boom 112 can include, but is not limited to, a thermoplastic polytherimide ("PEI") resin composite tube, a polyimide inflatable tube, a UV hardened polyimide tube, or a tube formed of a composite of glass fiber-reinforced polymer (fiberglass weave or winding).

Figure 3:
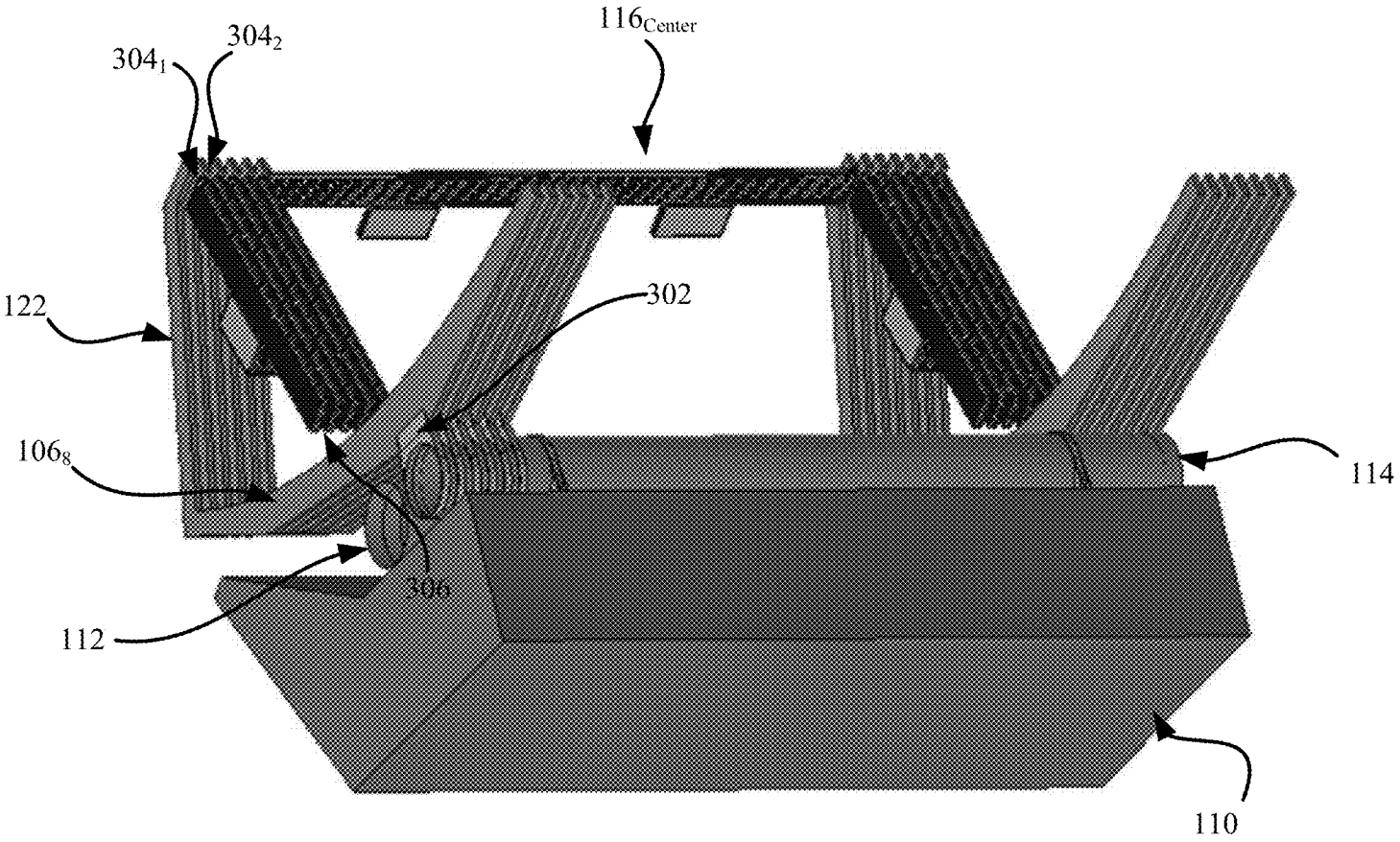
FIG. 3 provides an illustration showing the deployable trough structure of FIGS. 1-2, with a flexible element removed, in a collapsed or stowed position.

A drive train assembly (not visible in FIGS. 1-3) is positioned within the support structure 110 and is configured to telescopically extend the booms 112, 114 from their stowed configurations shown in FIG. 3 to their deployed configurations shown in FIGS. 1-2. The extending of the boom 112, 114 can be facilitated in accordance with various different conventional mechanisms. For example, the drive train assembly can include, but is not limited to, gears, motors, cords, ropes, threaded rods, pulleys, rolled elements, and/or locks. The telescoping segments $120_1$-$120_7$ of each boom 112, 114 may be extended sequentially or concurrently by the drive train assembly. The booms 112, 114 may be extended at the same time or at different times (e.g., one after the other).

In the sequential scenarios, the drive train assembly first causes the inner most telescoping segment $120_8$ of a telescoping boom 112, 114 to move in a direction away from the proximal end 124 of the boom 112, 114. Once the inner most telescoping segment $120_8$ reaches its fully extended position, the inner most telescoping segment $120_8$ is automatically coupled to the adjacent middle telescoping segment $120_7$ such that the inner most telescoping segment $120_8$ is maintained and remains in its extended position. This automatic coupling can be achieved in accordance with various different known coupling mechanisms. For example, the automatic coupling mechanism can include, but is not limited to, a resiliently biased pin 142 that is disposed on a proximal end 128 of the telescoping segment which is pushed through an aperture formed in a distal end 130 of another adjacent telescoping segment when the pin and the aperture become aligned with each other. Next, the drive train assembly causes the middle telescoping segment $120_7$ to move in a direction away from the proximal end 124 of the boom 112, 114, and to become coupled to an adjacent telescoping segment $120_6$ when the telescoping segment $120_7$ has reached its extended position. The process is repeated for causing the extension of the other remaining middle telescoping segments $120_6$, $120_5$, $120_4$, $120_3$, $120_2$, whereby the trough structure is deployed as shown in FIGS. 1-2.

Bulkheads $106_1$, $106_2$, $106_3$, $106_4$, $106_5$, $106_6$, $106_7$, $106_8$ (collectively referred to as "bulkheads 106") are provided for structurally supporting one or more flexible elements $104_1$, $104_2$, $104_3$, $104_4$, $104_5$, $104_6$, $104_7$ (collectively referred to as "flexible element(s) 104") so as to provide a parabolic trough shaped surface 136 when the telescoping booms 112, 114 are in their extended positions as shown in FIGS. 1-2. Notably, the bulkheads 106 may comprise compression-only members of structure 100, i.e., the bulkheads 106 may be designed such that they do not experience any bending or other deformation when the boom(s) 112, 114 is(are) in the fully extended position(s). In some scenarios, the bulkheads can be formed of composite honeycomb panel and/or a tube-and-fitting structure. The present solution is not limited in this regard.

It should be understood that the bulkheads 106 are respectively coupled to the booms 112, 114 via couplers 302 (visible in FIG. 3). More specifically, each bulkhead $106_3$-$106_8$ is securely coupled directly to a distal end 130 of a respective telescoping segment $120_2$-$120_7$. A bulkhead $106_1$ is securely coupled directly to a proximal end 128 of the outermost telescoping segment of the first boom 112 and/or is securely coupled directly to a distal end of the outermost telescoping segment of the second boom 114. Similarly, bulkhead $106_2$ is securely coupled directly to a proximal end 128 of the outermost telescoping segment of the second boom 114 and/or is securely coupled directly to a distal end of the outermost telescoping segment of the first boom 112. The couplers 302 can include, but are not limited to, clamps, jaws, studs, screws, and/or bolts. The innermost bulkheads could also be coupled directly to the base 110 by struts or frames.

Notably, the inner most telescoping segments $120_8$ of the booms 112, 114 do not have bulkheads coupled directly to their distal ends 130. These telescoping segments $120_8$ are provided for reacting to forces applied by the flexible element(s) 104 to the booms and/or bulkheads. As such, these telescoping segments $120_8$ are coupled to the closest bulkheads $106_8$ via tensioning cords 200, 202.

Figure 5:
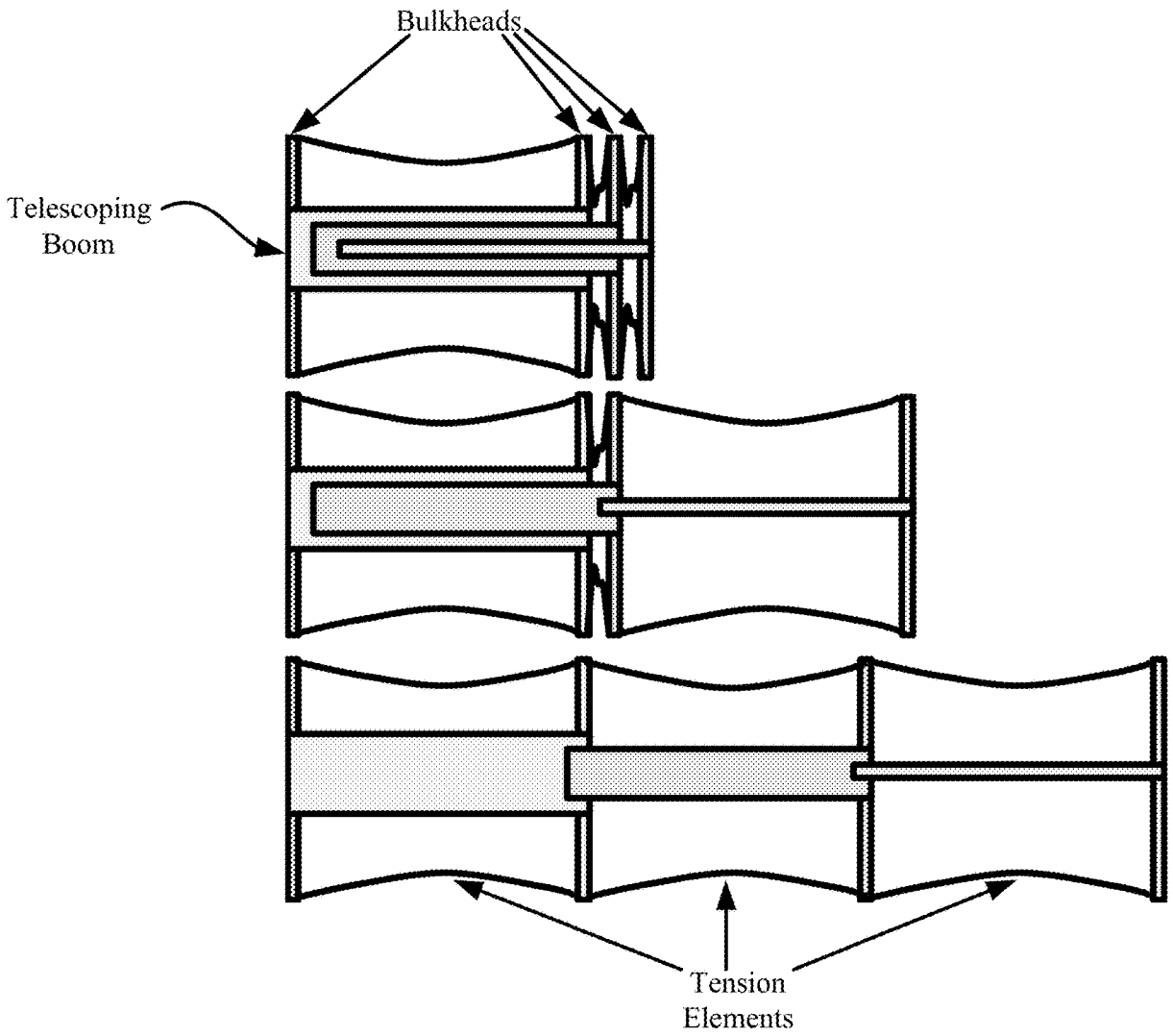
FIG. 5 provides an illustration that is useful for understanding transitions of flexible elements from an untensioned state to a tensioned state.

The flexible element(s) 104 is(are) coupled to elongate surfaces 138 of the bulkheads 106 via an adhesive, heat, welds, cords and/or other coupling means. The flexible element(s) 104 are formed of a flexible material (such as cords and/or a mesh) so that the flexible element(s) are in an untensioned state when the telescoping booms 112, 114 are in their collapsed positions shown in FIG. 3 and are in a tensioned state when the telescoping booms 112, 114 are in their extended positions shown in FIGS. 1-2. An illustration that is useful for understanding the transition(s) of flexible element(s) from the untensioned state to the tensioned state is provided in FIG. 5.

The flexible element(s) may be formed of a material such that the parabolic trough shaped surface 136 provides a reflector for an antenna system. In this scenario, the deployable trough structure 100 comprises feed panels 116. The feed panels 116 are coupled to the bulkheads 106, respectively. In this regard, couplers 122 are provided to facilitate the coupling between the feed panels and the bulkheads 106. The couplers 122 may comprise bars that extend between the feed panels and the bulkheads 106. The bars may be integrated with the bulkheads as a single piece, or alternatively comprise separate parts that are secured to the bulkheads via a securement mechanism (e.g., screws, bolts, welds, etc.). The couplers 122 are sized and shaped to locate the feed panels 116 at certain positions relative to the parabolic trough shaped surface 136 of the flexible element(s) 104.

Each feed panel 116 comprises one or more antenna feeds 140 arranged to face a concave surface of the parabolic trough shaped surface 136 that is intended to concentrate RF energy in a desired pattern. Each antenna feed 140 is configured to illuminate the concave surface 136 of the reflector 104 with RF energy or be illuminated by the reflector 104 that has gathered RF energy from a distant source, when the antenna system is in use.

In some scenarios, each antenna feed 140 comprises a single radiating element or a plurality of radiating elements which are disposed on a plate (which may or may not provide the ground plane) to form an array. The radiating elements can include, but are not limited to, patch antenna(s), dipole antenna(s), monopole antenna(s), horn(s), and/or helical coil(s). The antenna feed(s) 140 may be configured to operate as a phased array.

The feed panels 116 are designed so that they can be transitioned from a folded positon shown in FIG. 3 to an unfolded position shown in FIGS. 1-2 when the drive train assembly causes the telescoping boom(s) 112, 114 to be extended. In this regard, it should be appreciated that each feed panel has two parts $\mathbf{304}_1$, $\mathbf{304}_2$ which are coupled together via a hinge 306 or other bendable element (e.g., a bendable strip of material). An antenna feed may be provided with each of the two parts $\mathbf{304}_1$, $\mathbf{304}_2$ (as shown in FIGS. 1-3). Notably, the center feed panel $\mathbf{116}_{Center}$ does not fold or otherwise bend when the telescoping boom(s) 112, 114 is(are) collapsed as shown in FIG. 3.

Figure 4:
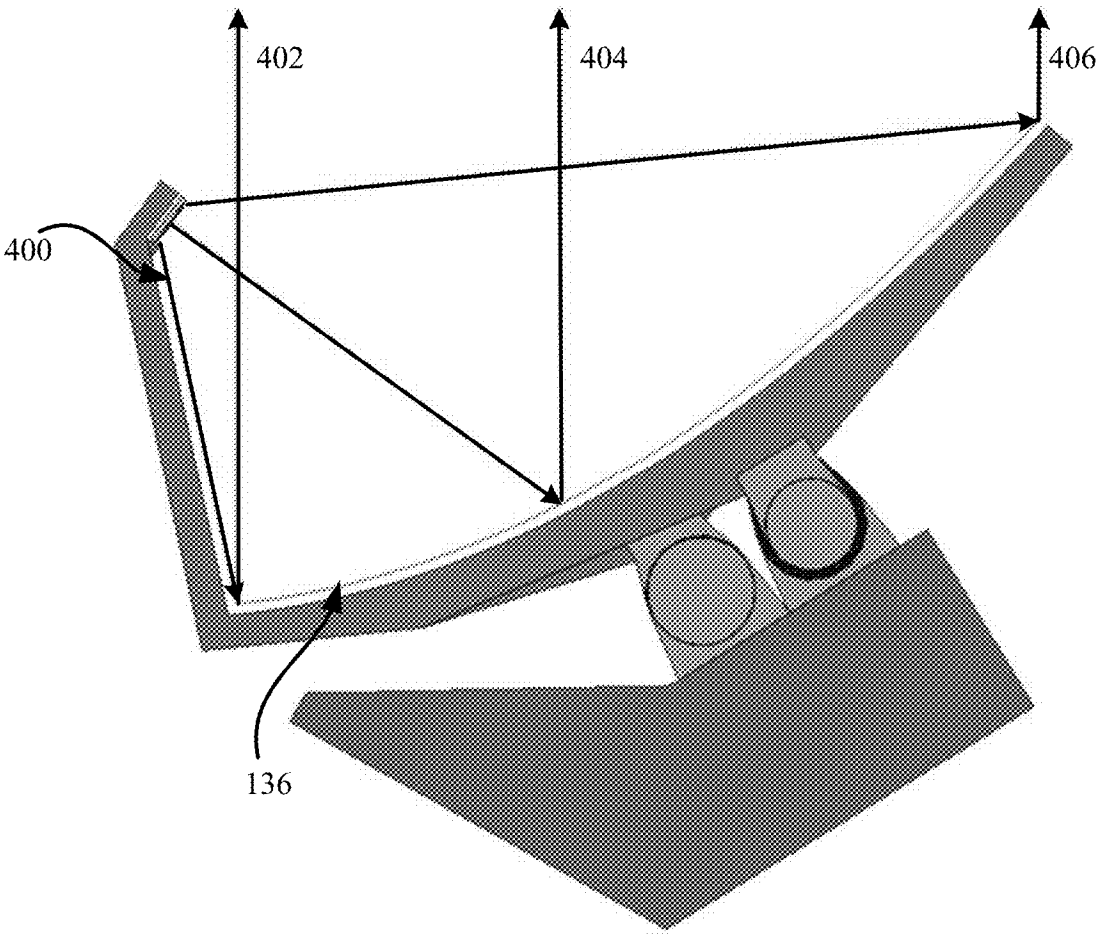
FIG. 4 provides a side view of the deployable trough structure of FIGS. 1-2.

A transmit scenario of the antenna feeds of panels 116 is illustrated in FIG. 4. It should be understood that the operation of the antenna feeds is reciprocal in the receive direction. Accordingly, both receive and transmit operations are supported for the antenna system. The resulting feed configuration of FIG. 4 shows that an RF feed beam 400 produced by the antenna feed panels 116 is directed toward the concave surface of the parabolic trough shaped surface 136. The RF feed beam 400 is reflected by the parabolic trough shaped surface 136 in a given direction shown by arrow 402, 404, 406.

In some scenarios (e.g., space based antenna applications), it is desirable to provide a cord network to facilitate support of the flexible element(s) 104 by the bulkheads and/or telescoping booms, and/or to provide strength to the structure such that the bulkheads and/or telescoping booms do not bend or otherwise experience deformation when the structure 100 is in its deployed position shown in FIGS. 1-2. Additional bulkhead extenders 632 are provided to facilitate formation and structural support of the cord network 600. The cord network 600 is designed to maintain the parabolic trough shape of the flexible element(s) 104 and/or prevent bending of the bulkheads and/or booms.

Figure 6:
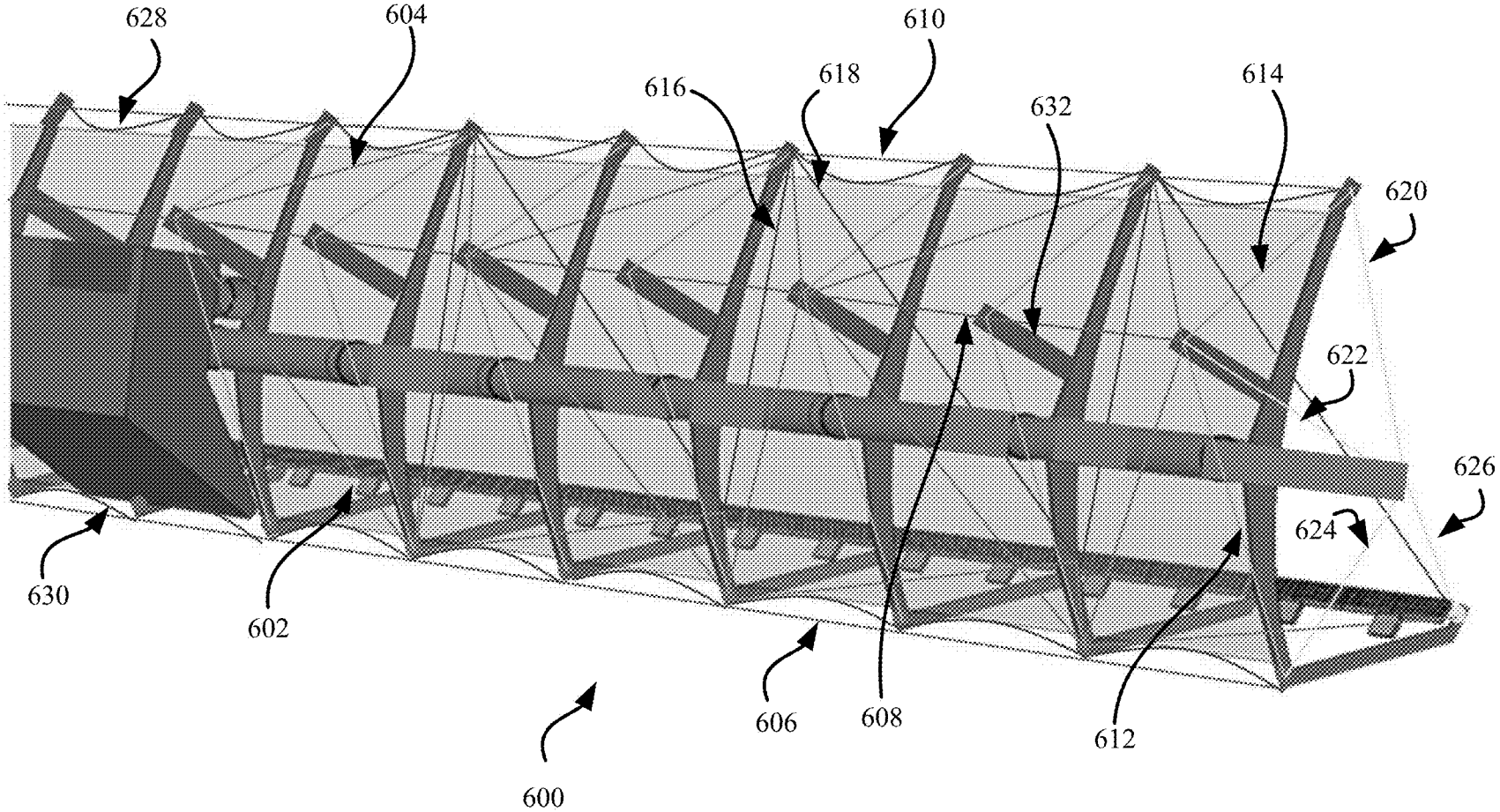
FIG. 6 provides an illustration of a deployable trough structure with a cord network to facilitate support of flexible elements by bulkheads and/or telescoping booms.

The cord network 600 comprises a plurality of cords 602-630 as shown in FIG. 6. The diagonal cords 602, 604, 616, 618 are used to stiffen the structure in torsion. The longeron cords 606, 608, 610 are used to stiffen the structure and balance tension of the flexible element(s) 104 across its depth. The backside cords 612, 614 react to tension of the flexible element(s) 104 across its width. The catenary cords 628, 630 are used to stiffen the structure and balance tension of the across its length. The tip cords 620, 622, 624, 626 are used to spread tension across the bulkheads. When the boom(s) is(are) in the extended position(s), the diagonal cords, longeron cords, backside cords, tip cords, and catenary cords are taught. All the cords are straight due to tension, except for the catenary cords which are curved. The catenary curve reacts to the tension of the flexible element 104 in the lateral direction in either discreet steps between individual lateral cords or in a smooth curve to tension a surface sheet such as mesh.

Figure 7:
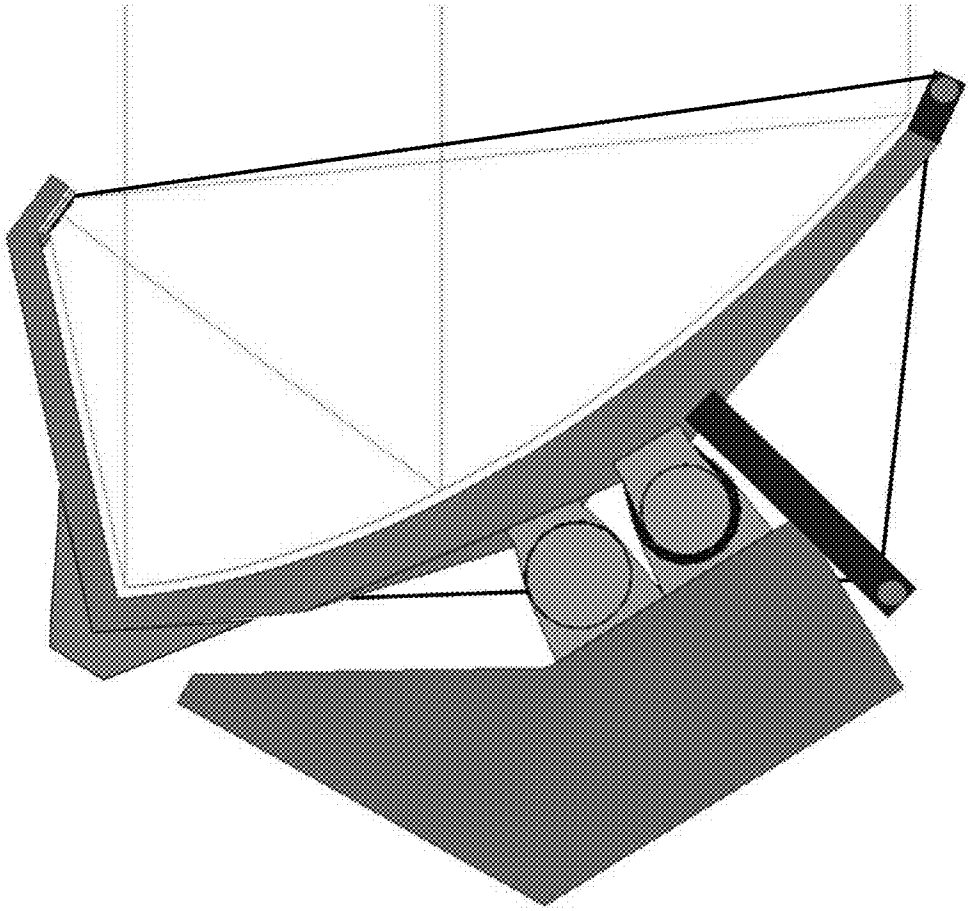
FIG. 7 is an illustration of the deployable trough structure shown in FIG. 6.

In some scenarios, the tension of the catenary cords 628, 630 is greater than the tension of the diagonal cords 602, 604, 616, 618, the longeron cords 606, 608, 610, and/or the backside cords 612, 614. For example, the catenary cords 628, 630 have a tension of ten pounds, while cords 602-610, 616, 618 have a tension of five pounds and cords 612, 614 have a tension of eight pounds. The present solution is not limited to the particulars of this example. FIG. 7 shows the side view of the deployable trough structure shown in FIG. 6 along with the cord network 600.

The present solution is not limited to the cord network architecture shown in FIGS. 6-7. For example, in other scenarios, the cord network is absent of cords 616 which extend across the front of the flexible element or reflector such that the cord network's interference with an antenna beam is eliminated or reduced, the diagonal cords 602, 604, 616, 618 may be oriented between different points or doubled to form cross between the ribs. The present solution is not limited in this regard.

Figure 8B:
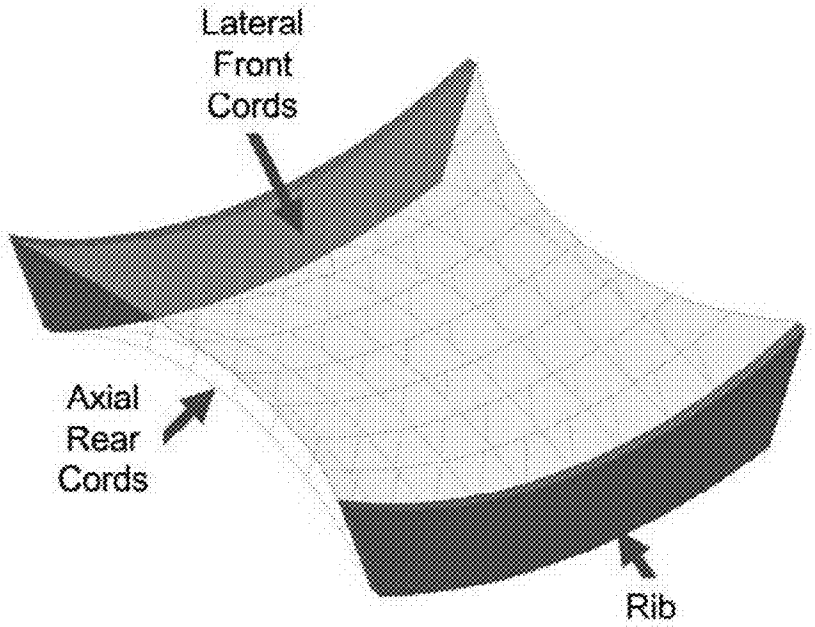
FIGS. 8*a*-8*b* (collectively referred to herein as FIG. 8) provide illustrations of illustrative cord trusses. The core truss of FIG. 8*a* comprises axial cords with vertical ties to axial rear cords. The core truss of FIG. 8*b* comprises front cords parallel to the ribs with vertical ties to axial rear cords.
Figure 8A:
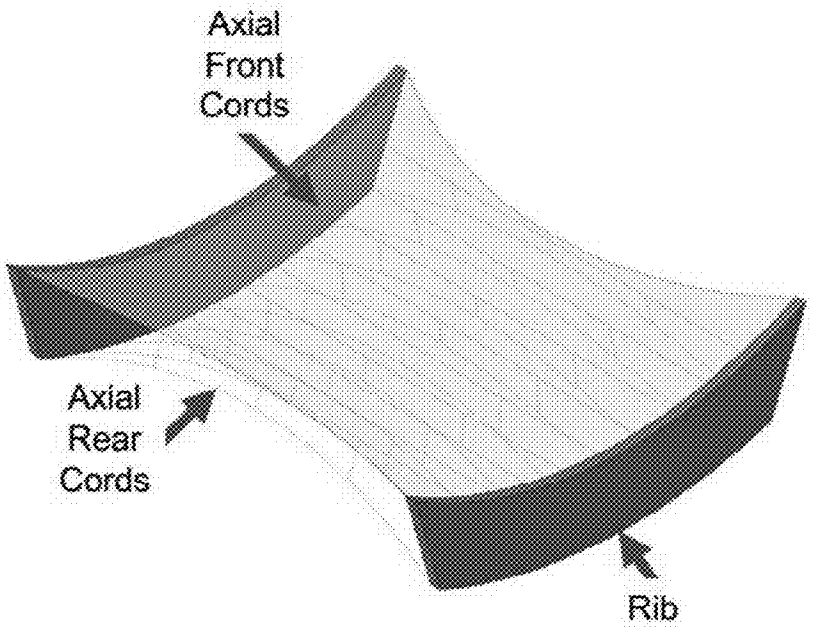

Referring now to FIG. 8, there are provided illustrations that show two configurations for the cords that shape the flexible surface element. More specifically, the core truss of FIG. 8*a* comprises axial cords with vertical ties to axial rear cords. The core truss of FIG. 8*b* comprises front cords parallel to the ribs with vertical ties to axial rear cords. Both configurations use front cords that are in intimate contact with the surface and rear cords that are spaced behind the surface on the non-reflecting side. The front and rear cords are joined with ties that are used to correct the position of the front cords by pulling tension towards the rear cords. In the first configuration of FIG. 8*a*, the front cords are nominally straight, however the tension in the flexible mesh causes mesh and connected front cords to bow inwards due to the unbalanced load from the curved shape of the mesh. The ties and rear cords apply out of plane forces to react the unbalanced mesh load. In the second configuration of FIG. 8*b*, the front cords are also in intimate contact with the surface, but are oriented parallel to the ribs and therefore curve along the desired parabola. These cords also tend to bulge inward with the mesh and the mesh loads are reacted through the ties to the rear cords. The present solution is not limited to the two configurations shown in FIG. 8. For example, in some scenarios, the rear cords could be parallel to the ribs with the front cords in either direction.

Figure 9:
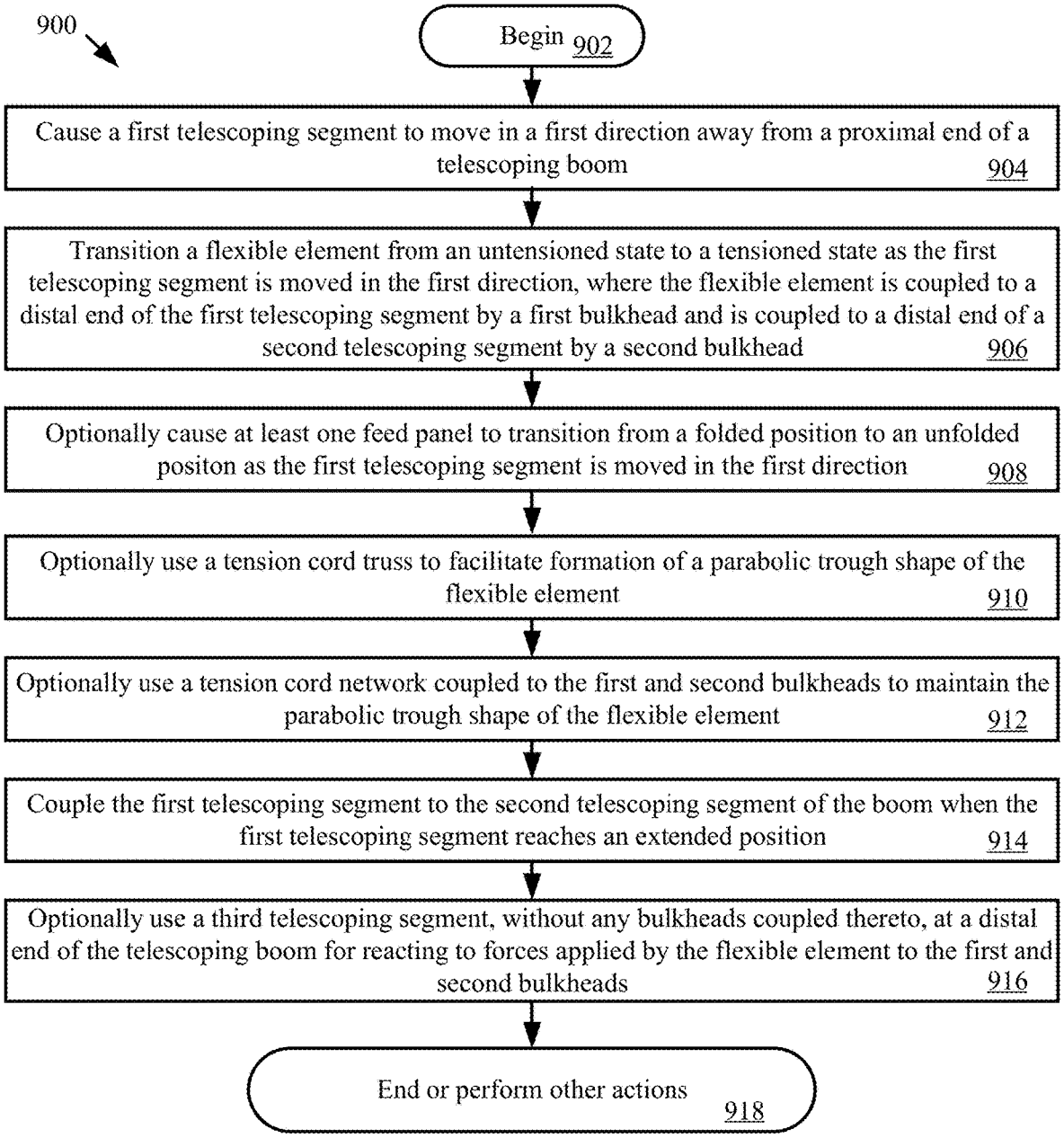
FIG. 9 provides a flow diagram of an illustrative method for deploying a trough structure.

Referring now to FIG. 9, there is provided a flow diagram of an illustrative method 900 for deploying a trough structure (e.g., trough structure 100 of FIG. 1). Method 900 begins with 902 and continues with 904 where a first telescoping segment (e.g., telescoping segment $\mathbf{120}_2$, $\mathbf{120}_3$, $\mathbf{120}_4$, $\mathbf{120}_5$, $\mathbf{120}_6$ or $\mathbf{120}_7$ of FIGS. 1-3) is caused to move in a first direction (e.g., direction 132 of FIG. 1) away from a proximal end (e.g., proximal end 124 of FIG. 1) of a telescoping boom (e.g., telescoping boom 112 of FIGS. 1-3). Next in 906, a flexible element (e.g., flexible element $\mathbf{104}_2$, $\mathbf{104}_3$, $\mathbf{104}_4$, $\mathbf{104}_5$, $\mathbf{104}_6$ or $\mathbf{104}_7$ of FIGS. 1-3) is transitioned from an untensioned state to a tensioned state as the first telescoping segment is moved in the first direction. In this regard, it should be understood that the flexible element is coupled to a distal end (e.g., distal end 130 of FIG. 1) of the first telescoping segment by a first bulkhead (e.g., bulkhead $\mathbf{106}_3$, $\mathbf{106}_4$, $\mathbf{106}_5$, $\mathbf{106}_6$, $\mathbf{106}_6$, $\mathbf{106}_7$ or $\mathbf{106}_8$ of FIGS. 1-3), and is coupled to a distal end of a second telescoping segment by a second bulkhead (e.g., bulkhead $\mathbf{106}_2$, $\mathbf{106}_3$, $\mathbf{106}_4$, $\mathbf{106}_5$, $\mathbf{106}_6$, $\mathbf{106}_6$ or $\mathbf{106}_7$ of FIGS. 1-3).

In 908, at least one feed panel (e.g., feed panel 116 of FIGS. 1-3) is optionally caused to transition from a folded position to an unfolded position as the first telescoping segment is moved in the first direction. The feed panel is coupled between the first and second bulkheads. The operations of 908 are performed in scenarios where the flexible element comprises a reflector for an antenna system. The feed panel can be used to illuminate the reflector with RF energy during operation of the antenna system.

In 910, a tension cord truss can optionally be used to facilitate formation of the parabolic trough shape of the flexible element. In 912, a tension cord network (coupled to the first and second bulkheads) is optionally used to maintain the parabolic trough shape of the flexible element and/or to prevent bending or other deformation of the bulkheads and/or booms while the flexible element is in the tensioned state. The tension cord network may comprise at least one first taught cord (e.g., diagonal cord 602, 604, 616 and/or 618 of FIG. 6) that extends diagonally between the first and second bulkheads, at least one second taught cord (e.g., longeron cord 606, 608 and/or 610 of FIG. 6) that extends between adjacent ends of the first and second bulkheads, and/or at least one catenary cord (e.g., catenary cord 628 and/or 630 of FIG. 6) that extends between the adjacent ends of the first and second bulkheads.

In 914, the first telescoping segment is coupled to the second telescoping segment of the boom when the first telescoping segment reaches an extended position. In 916, a third telescoping segment (e.g., telescoping segment $\mathbf{120}_8$ of FIGS. 1-3) (without any bulkheads coupled thereto) is optionally used at a distal end (e.g., distal end 126 of FIG. 1) of the telescoping boom for reacting to forces applied by the flexible element to the first and second bulkheads. A distal end of the third telescoping segment is coupled to the first bulkhead via at least one cord (e.g., cords 200, 202 of FIG. 2). Subsequently, 918 is performed where method 800 ends or other actions are performed.

Figure 10:
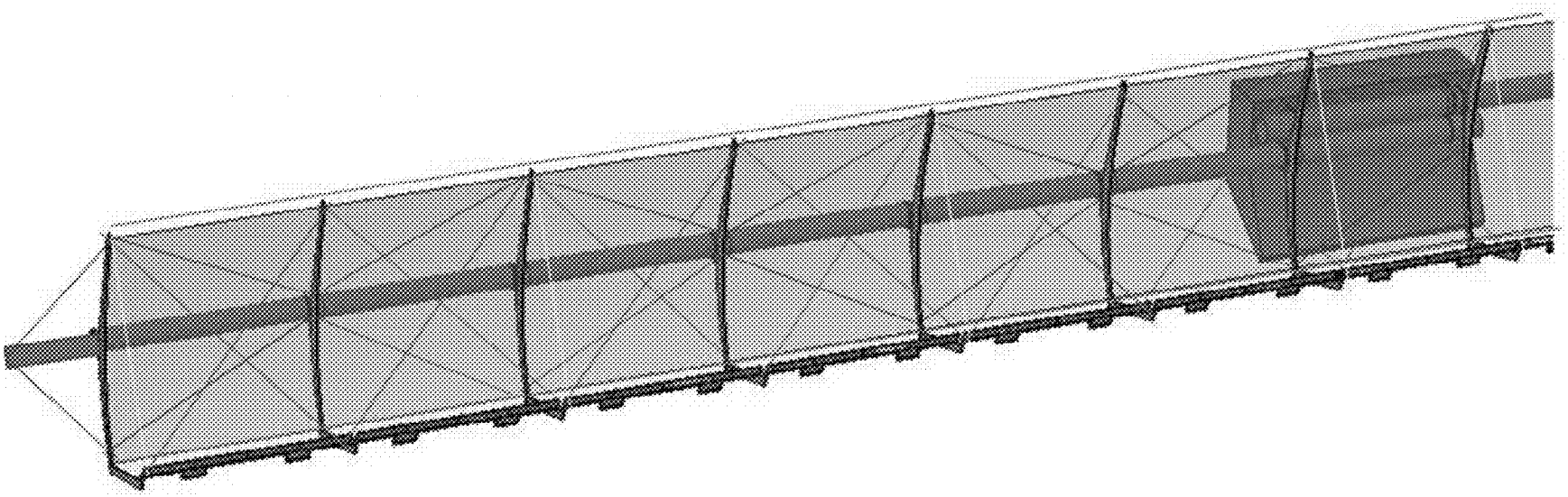
FIG. 10 provides an illustration of another illustrative architecture for a deployable trough structure.
Figure 11:
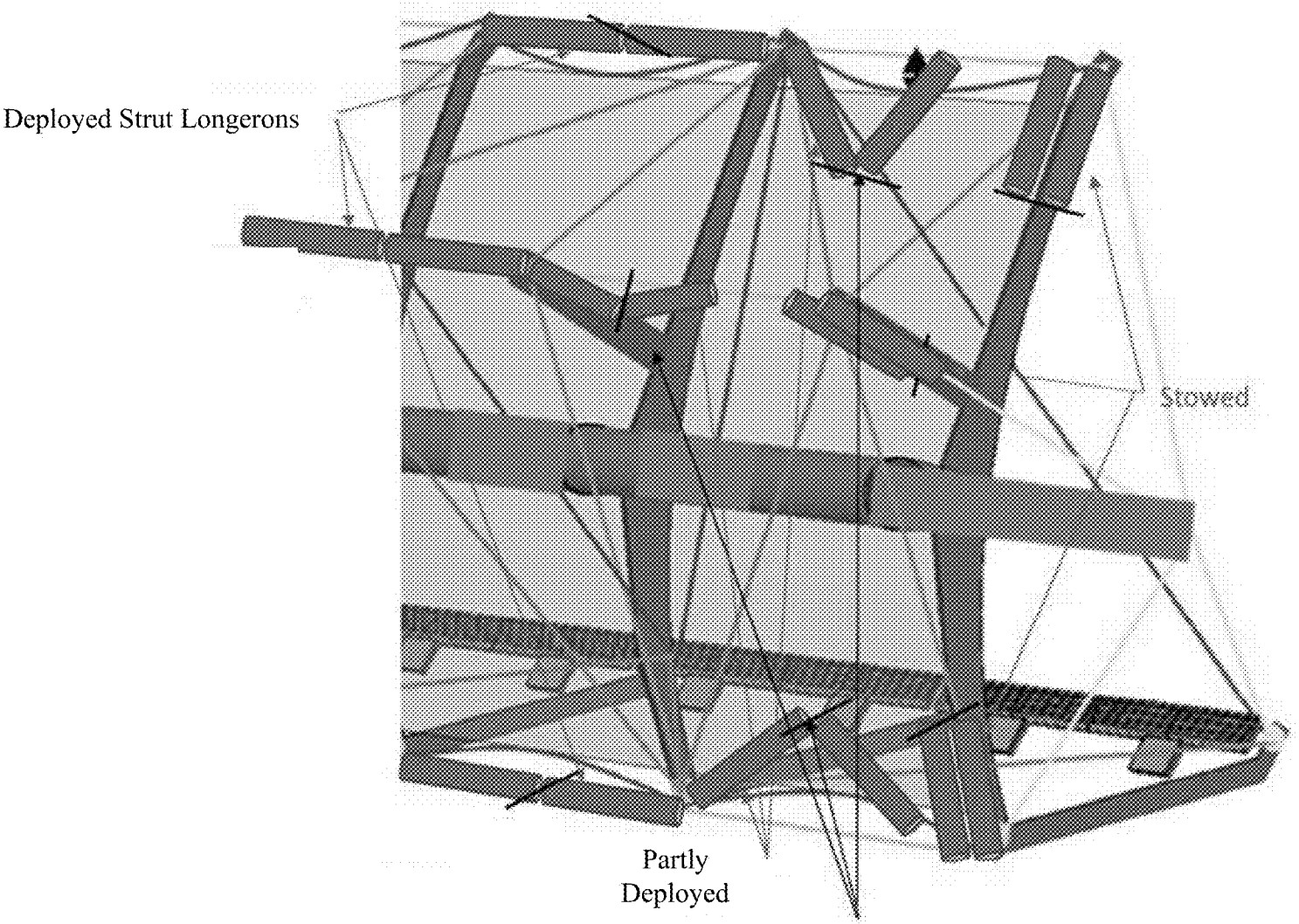
FIG. 11 provides an illustration of yet another illustrative architecture for a deployable trough structure.

The present solution is not limited to the deployable trough structure discussed above. Other deployable trough structures are shown in FIGS. 10-11. In FIG. 10, the bulkhead extensions have been eliminated, and the cross diagram structure cords of the truss in front of the surface are used to stiffen the structure. In this regard, it should be noted that the tension cord truss of FIG. 6 is configured to eliminate a bending of the first telescoping boom resulting from at least one of a load applied by the flexible element and an environmental load. In contrast, the tension cord truss of FIG. 10 is configured to react along with the telescoping booms to at least one of a load applied by the flexible element and an environmental load, i.e., both the telescoping booms and the tension cord truss react to a load applied by the flexible element and/or an environmental load (e.g., caused by movement of a satellite or other space craft).

In FIG. 11, the cord truss is replaced with rigid foldable elements or struts. The rigid foldable elements are in a folded state when in a stowed position (not shown), and are in an unfolded state when in a deployed position as shown in FIG. 11. A hinge axis is rotated to cause the struts to fold in the same direction as the rib at each location.

The described features, advantages and characteristics disclosed herein may be combined in any suitable manner. One skilled in the relevant art will recognize, in light of the description herein, that the disclosed systems and/or methods can be practiced without one or more of the specific features. In other instances, additional features and advantages may be recognized in certain scenarios that may not be present in all instances.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

We claim:

1. A method for deploying a trough structure, comprising:

causing a first telescoping segment to move in a first direction away from a proximal end of a telescoping boom;

transitioning a flexible element from an untensioned state to a tensioned state as the first telescoping segment is moved in the first direction, where the flexible element is coupled to a distal end of the first telescoping segment by a first bulkhead and is coupled to a distal end of a second telescoping segment by a second bulkhead;

causing a variable geometry of at least one first feed panel to transition from a folded geometry to an unfolded geometry as the first telescoping segment is moved in the first direction;

coupling the first telescoping segment to the second telescoping segment of the telescoping boom when the first telescoping segment reaches an extended position; and providing a second feed panel at the proximal end of the telescoping boom that has a static geometry;

wherein the flexible element has a parabolic trough shape when in the tensioned state.

2. The method according to claim 1, further comprising using a third telescoping segment, without any bulkheads coupled thereto, at a distal end of the telescoping boom for reacting to forces applied by the flexible element to the first and second bulkheads.

3. The method according to claim 2, wherein a distal end of the third telescoping segment is coupled to the first bulkhead via at least one cord.

4. The method according to claim 1, further comprising using a tension cord network coupled to the first and second bulkheads to maintain the parabolic trough shape of the flexible element.

5. The method according to claim 4, wherein the tension cord network comprises at least one of a first taught cord that extends diagonally between the first and second bulkheads, a second taught cord that extends between adjacent ends of the first and second bulkheads, and a catenary cord that extends between the adjacent ends of the first and second bulkheads.

6. The method according to claim 1, further comprising using a tension cord truss to facilitate formation of the parabolic trough shape of the flexible element.

7. The method according to claim 1, wherein the flexible element comprises a reflector for an antenna system.

8. The method according to claim 1, wherein the second feed panel is also provided at a proximal end of another telescoping boom of the trough structure that at least partially overlaps the proximal end of the telescoping boom.

9. The method according to claim 1, wherein the at least one first feed panel is coupled between the first and second bulkheads.

10. The method according to claim 1, further comprising using the at least one first feed panel and the second feed panel to illuminate the reflector with Radio Frequency ("RF") energy.

11. A deployable trough structure, comprising:

a first telescoping boom;

at least first and second bulkheads coupled to the first telescoping boom;

a flexible element that is (a) coupled to a distal end of a first telescoping segment of the telescoping boom by the first bulkhead, and (b) coupled to a distal end of a second telescoping segment of the first telescoping boom by the second bulkhead;

a drive train assembly that causes the first telescoping segment of the first telescoping boom to move in a first direction away from a proximal end of the first telescoping boom;

a coupler for coupling the first telescoping segment to the second telescoping segment of the first telescoping boom when the first telescoping segment reaches an extended position;

at least one first feed panel having a variable geometry transitionable between a folded geometry to an unfolded geometry as the first telescoping segment is moved in the first direction; and a second feed panel that is provided at the proximal end of the first telescoping boom and that has a static geometry;

wherein the flexible element transitions from an untensioned state to a tensioned state as the first telescoping segment is moved in the first direction, the flexible element having a parabolic trough shape when in the tensioned state.

12. The deployable trough structure according to claim 11, wherein a third telescoping segment is provided at a distal end of the first telescoping boom without any bulkheads coupled thereto, and is used for reacting to forces applied by the flexible element to the first and second bulkheads.

13. The deployable trough structure according to claim 12, wherein a distal end of the third telescoping segment is coupled to the first bulkhead via at least one cord.

14. The deployable trough structure according to claim 11, further comprising a tension cord network coupled to the first and second bulkheads that is used to maintain the parabolic trough shape of the flexible element.

15. The deployable trough structure according to claim 14, wherein the tension cord network comprises at least one of a first taught cord that extends diagonally between the first and second bulkheads, a second taught cord that extends between adjacent ends of the first and second bulkheads, and a catenary cord that extends between the adjacent ends of the first and second bulkheads.

16. The deployable trough structure according to claim 11, further comprising a tension cord truss that is used to facilitate formation of the parabolic trough shape of the flexible element.

17. The deployable trough structure according to claim 16, wherein the tension cord truss is configured to eliminate a bending of the first telescoping boom resulting from at least one of a load applied by the flexible element and an environmental load.

18. The deployable trough structure according to claim 16, wherein the tension cord truss is configured to react along with the first telescoping boom to at least one of a load applied by the flexible element and an environmental load.

19. The deployable trough structure according to claim 11, further comprising a plurality of foldable elements that are used facilitate formation of the parabolic trough shape of the flexible element.

20. The deployable trough structure according to claim 11, wherein the flexible element comprises a reflector for an antenna system.

21. The deployable trough structure according to claim 11, wherein the second feed panel is also provided at a proximal end of a second telescoping boom of the deployable trough structure that at least partially overlaps the proximal end of the first telescoping boom.

22. The deployable trough structure according to claim 11, wherein the at least one first feed panel is coupled between the first and second bulkheads.

23. The deployable trough structure according to claim 11, wherein the at least one feed panel is used to illuminate the reflector with Radio Frequency ("RF") energy.

24. The deployable trough structure according to claim 11, further comprising a second telescoping boom that is offset from the first telescoping boom and configured to be deployed in a direction opposite from the direction in which the first telescoping boom deploys.

25. The deployable trough structure according to claim 24, wherein at least a portion of second telescoping boom overlaps at least a portion of the first telescoping boom when the first and second telescoping booms are in a stowed position and extended position.

* * * * *